US005820297A

United States Patent [19]

Middleton

[11] Patent Number: 5,820,297

[45] Date of Patent: Oct. 13, 1998

[54] PERMANENT BERM DEVICE

[75] Inventor: Dennis G. Middleton, Anderson, S.C.

[73] Assignee: New Pig Corporation, Tipton, Pa.

[21] Appl. No.: 704,392

[22] Filed: Aug. 27, 1996

(Under 37 CFR 1.47)

[51] Int. Cl.[6] ..... E02B 7/02

[52] U.S. Cl. ..... 405/52; 52/102; 405/107; 405/114

[58] Field of Search ..... 405/52, 128, 114, 405/107, 108, 115; 52/102

[56] References Cited

U.S. PATENT DOCUMENTS

| | | | |
|---|---|---|---|
| 1,742,369 | 1/1930 | Probst et al. . | |
| 3,568,453 | 3/1971 | Ziegenmeyer . | |
| 3,847,722 | 11/1974 | Kistner . | |
| 4,031,676 | 6/1977 | Dally . | |
| 4,692,060 | 9/1987 | Jackson, III . | |
| 4,765,775 | 8/1988 | Kroger . | |
| 4,792,399 | 12/1988 | Haney et al. | 210/484 |
| 4,799,821 | 1/1989 | Brodersen . | |
| 4,869,617 | 9/1989 | Chiodo | 405/114 X |
| 4,921,373 | 5/1990 | Coffey . | |
| 4,981,391 | 1/1991 | Klementovich . | |
| 4,988,234 | 1/1991 | Henkel et al. . | |
| 5,030,031 | 7/1991 | Brown . | |
| 5,059,065 | 10/1991 | Doolaege . | |
| 5,236,281 | 8/1993 | Middleton . | |
| 5,462,655 | 10/1995 | Ladd et al. | 405/52 X |

FOREIGN PATENT DOCUMENTS

| | | |
|---|---|---|
| 0 368 107 A1 | 5/1990 | European Pat. Off. . |
| WO 94/16974 | 8/1994 | WIPO . |
| WO 96/27710 | 9/1996 | WIPO . |
| WO 97/01003 | 1/1997 | WIPO . |

*Primary Examiner*—Dennis L. Taylor
*Attorney, Agent, or Firm*—Buchanan Ingersoll, P.C.

[57] ABSTRACT

A device for building a berm to contain a leak or spill has a plurality of corner members each having an elongated member spaced there between. The elongated members are formed from a pliable strip having a vinyl housing and being filled with a foam material having shape retention properties. The elongated members are sized and cut at the workplace to form a berm of sufficient size to meet the present spill containment problem. Once the side members and corner members have been selected and arranged, they are secured to the building floor by a caulking compound. Strapping material can then be applied, if necessary, to seal the joints between the corner members and the side members of the berm.

9 Claims, 3 Drawing Sheets

PERMANENT BERM DEVICE

BACKGROUND OF THE INVENTION

1. Field of the Invention

This invention is related to devices for controlling fluid flow and, more particularly, to permanent or temporary berm devices for containing liquids.

2. Background of the Invention

Removable liquid blocking devices for use on surfaces, such as building floors are well-known in the art. U.S. Pat. No. 4,031,676 discloses a rubber water blocking device having a bottom surface with a plurality of recessed disc portions which define suction cups. The bottom is engaged on smooth surfaces to form a semi-permanent dam structure. The device may be provided in straight sections and curved sections, with the sections interlocked by a tongue and groove arrangement. This device is unduly expensive to manufacture as any mold which forms the device would have to provide several suction cups on the bottom surface. The device also suffers from reduced adaptability because it is provided in sections of predetermined length which are not easily adapted on site to conform to various sized spill areas.

U.S. Pat. No. 4,981,391 discloses an inflatable, portable dam apparatus having a tubular structure and a bottom sheet of flexible material. Inflation of the dam is unduly time consuming, especially in cases where immediate, on-site liquid control is the desired object.

Similarly, U.S. Pat. No. 5,059,065 discloses a fluid-filled damming structuring having a coupling sleeve arrangement for interconnecting and receiving adjacent ends of the damming structure. U.S. Pat. No. 3,847,722 discloses a permeable, laminated web impregnated with a urethane prepolymer to stop water leaks in small holes or crevices. The prepolymer reacts with water to form a swollen, adherent hydrogel. However, the web does not have substantial thickness so it cannot be placed on a level spill surface for controlling or containing liquids. A permeable filler material, such as wood chips, may be placed inside the web, but this is impractical for on-site spill control.

More recently, U.S. Pat. No. 5,236,281 discloses a dike for damming or diverting liquids in which an elongated, pliable dike is provided in which the exterior surface is of a tacky nature. The dike is readily pliable to conform to various damming configurations. Portions of this dike may be severed on site by the user, without special tools, to tailor the dike for specific damming needs. The tacky nature of the exposed surface provides both the desired damming structure and the adherence necessary to secure the dike on a spill surface and create a proper seal. Although this dike provides an excellent temporary damming device, it is not readily adapted for permanent diking purposes.

According, it is an object of the present invention to provide a device for forming a temporary or permanent berm for containing liquids on spill surfaces, such as building floors. It is a further object to provide a device which may be easily conformed and tailored to meet a variety of configurations. It is still a further object to provide a device which can form a permanent seal but is nevertheless removable with a minimum of effort.

SUMMARY OF THE INVENTION

A device for forming a temporary or permanent berm to contain a spill or leak is provided. The device includes a plurality of elongated members formed from a housing and a filler material. Preferably, the housing is a vinyl or polyurethane material having a hollow core provided longitudinally therein. Alternatively, the housing may be formed from an extruded plastic material or other rigid material. This hollow core is filled with a filler material such as foam, cellulose, or synthetic or mineral materials.

The device further includes a plurality of joint members which are adapted to connect a pair of the elongated members. The joint members are provided with a defined angle and serve as comers of the berm. The ends of the joint members conform in geometry to the ends of the elongated members.

When the elongated members and joint members are selected, they can be secured to the floor surrounding the spill or leak by means of a sealant such as caulk. Such sealant can also be formed from silicone, polyurethane or other material which secures the housing to the floor. Once the berm has been constructed, strapping material may be provided to cover any exposed areas of the berm assembly.

One of the advantages of the present invention is that the elongated members can be cut from a longer strip of elongated material at the work site in order to construct a berm having the desired dimensions. The ability to cut the elongated members to size affords an added degree of flexibility which allows the perm of the present invention to be used for any number of configurations.

DETAILED DESCRIPTION OF THE PREFERRED EMBODIMENTS

Figure 1:
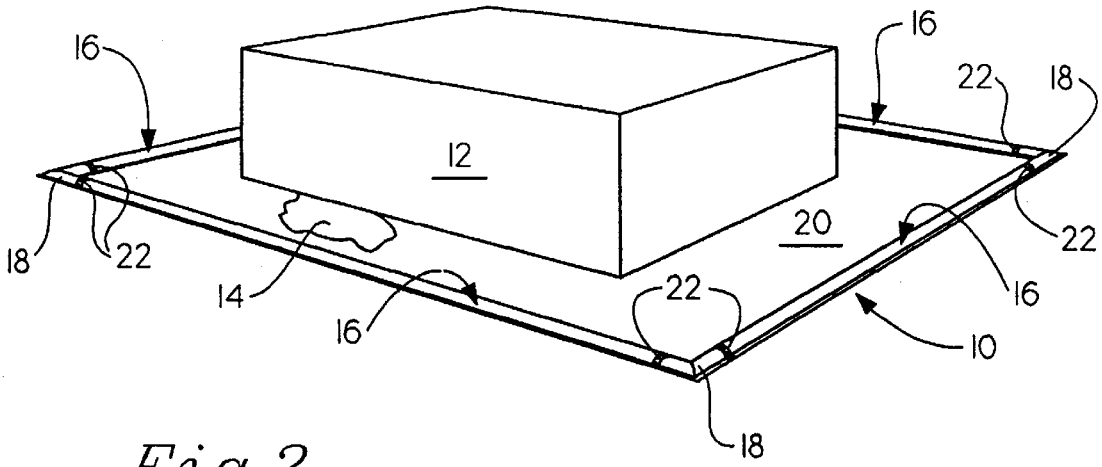
FIG. 1 is a perspective view of a first presently-preferred embodiment of a berm in accordance with the present invention.

FIG. 1 shows a berm 10 which surrounds machinery 12 and spill or leak 14. Alternatively, berm 10 can be constructed around a spill or leak 14 with or without the presence of machinery 12.

As shown in FIG. 1, berm 10 can be formed in the shape of a rectangle surrounding spill or leak 14. In this arrangement, berm 10 includes four elongated members 16 which define the four sides of the rectangular berm 10. Joint members 18 are provided at each of the corners of berm 10. Elongated members 16 and joint members 18 are brought into final position and are secured to the floor 20 by means of a caulking compound. Strapping material 22 can be cut to size to cover the boundary of joint member 18 and elongated member 16. Joint members 18 may be provided in right-angle configuration as shown herein in which case a rectangular berm 10 is formed. Alternatively, joint members 18 can be provided in other configurations to provide a triangular-shaped berm, a pentagonal-shaped berm, or other multiple-sided berm. Joint members 18 can also be configured to provide a berm 10 in the shape of a parallelogram or rhombus or other geometric configuration.

Figure 2:
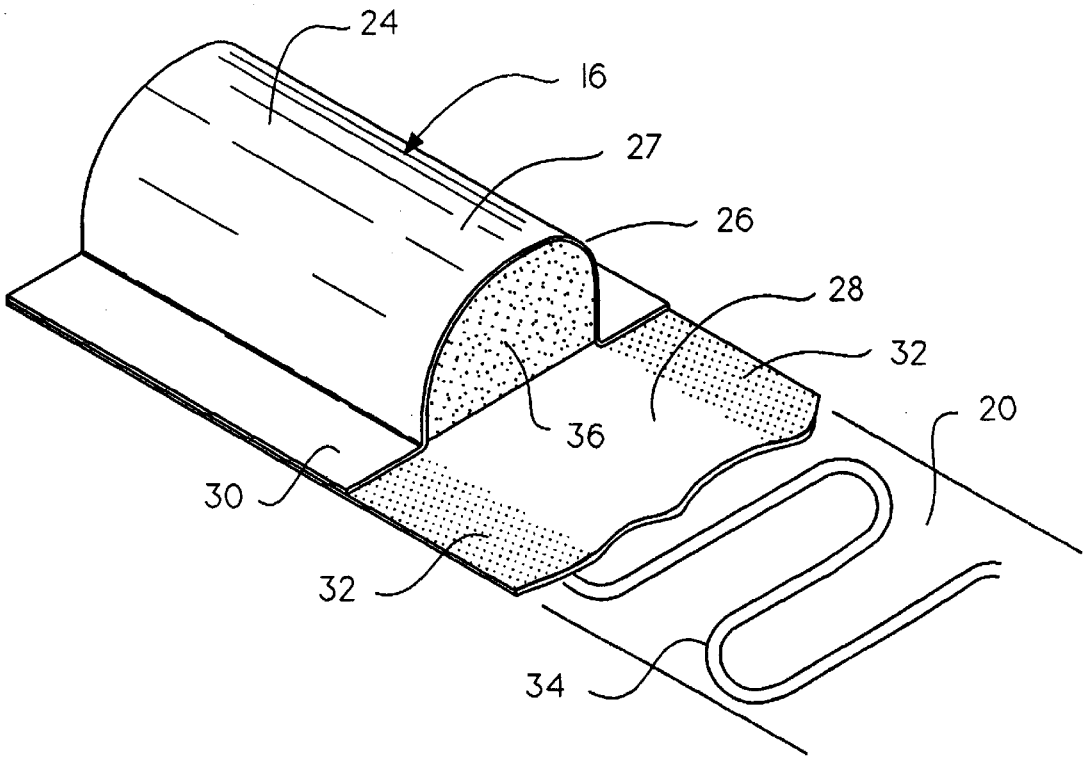
FIG. 2 is an enlarged view of the berm of FIG. 1 and means for securing the berm to a floor.

FIG. 2 is an enlarged fragment view of berm 10 which illustrates the manner in which the components of berm 10 are secured together. As shown in FIG. 2, elongated member 16 is formed from housing 24 having a hollow center 26 provided longitudinally therein. Preferably, housing member 24 is formed in two pieces having top member 27 and base member 28. Top member 27 includes flanges 30 which extend laterally from hollow center 26 and overlap the end portions 32 of base member 28. Flanges 30 and end portions 32 provide a bonding area to secure top member 27 and base member 28. Caulking compound 34 provided on floor 20 adheres to a bottom surface of base member 28 and secures berm 10 to floor 20.

Figure 3:
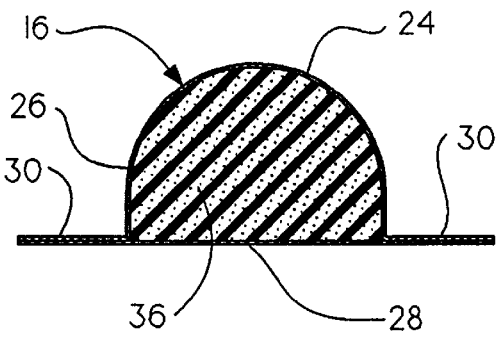
FIG. 3 is a transverse sectional view of the berm of FIG. 1.
Figure 4:
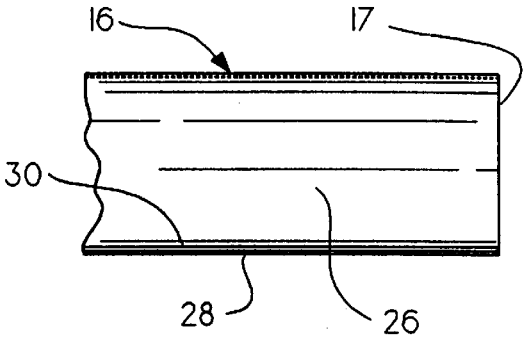
FIG. 4 is a fragmentary elevational view of the berm of FIG. 1.
Figure 5:
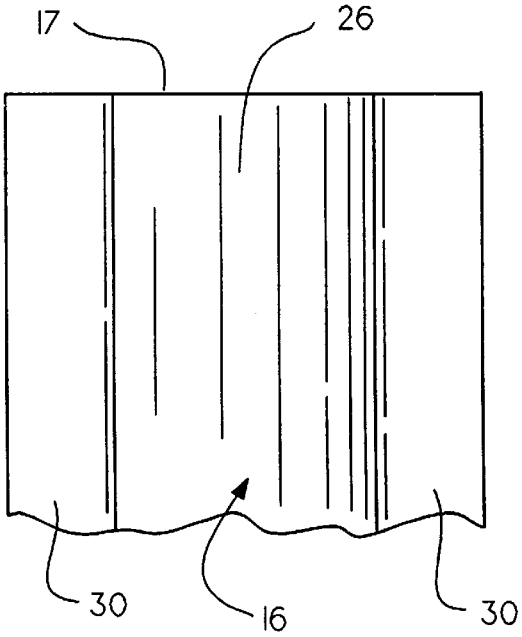
FIG. 5 is a plan view of the berm of FIG. 4.
Figure 6:
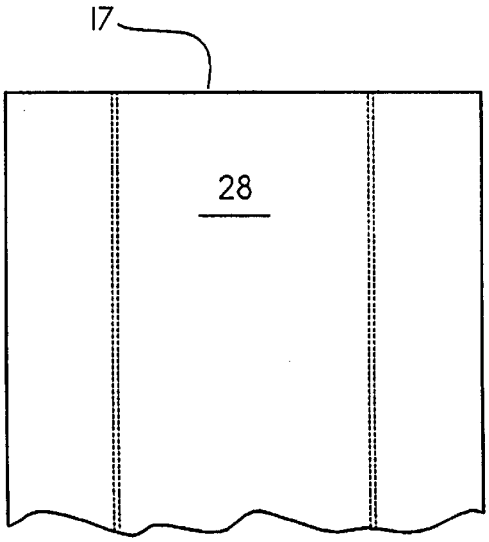
FIG. 6 is a bottom view of the berm of FIG. 5.

FIGS. 3, 4, 5, and 6 show transverse sectional, fragmentary elevational, plan, and bottom views, respectively, of elongated member 16 of berm 10. FIGS. 3–6 provide further illustration of the features of the present invention. Preferably, elongated member 16 is formed in a semicircular arrangement as shown in FIG. 3. Alternatively, elongated member 16 may be formed in a triangular cross section or any other cross section having a substantial height to serve as a berm to contain liquid. As shown in FIG. 3, hollow center 26 of housing member 24 is filled with filling material 36.

Figure 7:
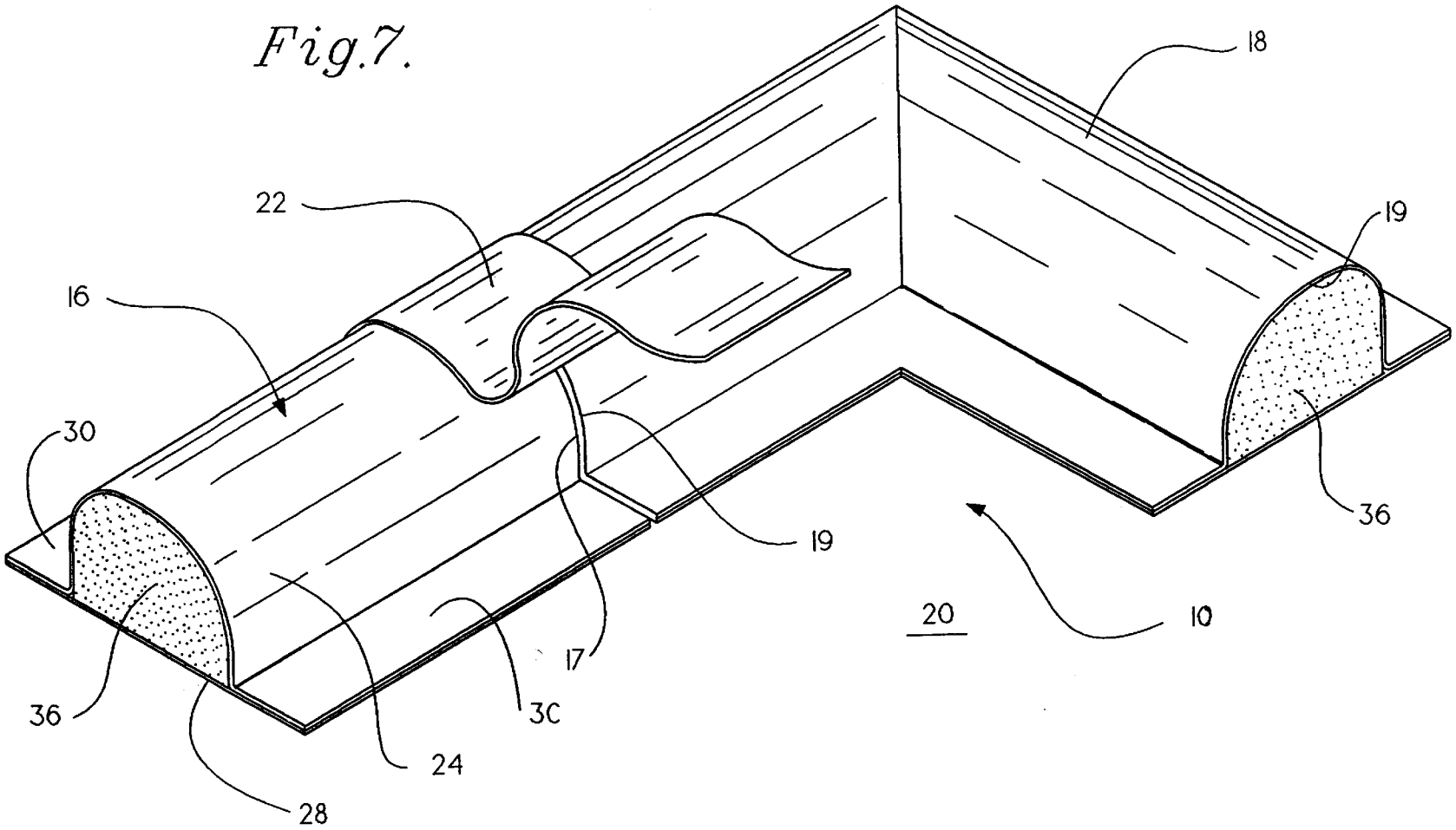
FIG. 7 is a perspective view of a corner of the berm of FIG. 1 showing the strapping sealing means.

FIG. 7 is a close-up of a corner of the berm 10 of the present invention. Therein, end 17 of elongated member 16 and end 19 of joint member 18 are brought into close contact. Elongated member 16 and joint member 18 are then secured to the floor 20. Strapping material 22 covers the junction of elongated members 16 and joint members 18 to provide a complete seal to berm 10 and to allow berm 10 to completely contain any liquid spilled within the inner perimeter thereof.

Figure 8:
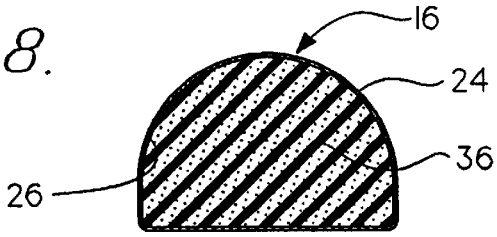
FIG. 8 is a transverse sectional view of a second presently-preferred embodiment of a berm in accordance with the present invention.

FIG. 8 illustrates an alternative embodiment of the elongated member 16 of berm 10. In contrast to the elongated member 16 discussed above, FIG. 8 shows elongated member 16 being formed in a single piece. In the embodiment of FIG. 8, a one-piece housing 24 having a hollow center 26 is adapted to receive filling material 36.

Preferably, hollow center 26 of elongated member 16 is filled with foam 36. However, any flexible, pliable material can be used as the filler including cellulose, and synthetic or mineral materials. Preferably, the foam is an extruded, closed-sealed polyolefin. The criteria for selecting the polyolefin material is that the material must have a shape retention property such that when compressed, the foam material returns to generally its original shape.

Preferably, housing 24 is made from vinyl. Alternatively, housing 24 may be formed from an extruded plastic material or other rigid material. In addition to vinyl, housing 24 can also be formed from polyurethane or polyols. If made from vinyl, housing 24 is preferably made from vinyl having a density of 23 oz/yd$^2$.

Because of the pliability of elongated member 16, the berm device of the present invention can be provided in a kit that includes at least one coil of elongated member 16, at least four right-angled joint members 18, a sheet of vinyl strapping 22, and caulking compound. Preferably, the caulking compound used in the present invention is Dow Corning silicone. However, other caulking type sealant such as polyurethane can be used in the present invention. The caulking compound, as well as the vinyl compound used in the outer housing of the elongated member 16 and in joint member 18 and vinyl strapping 22 must be selected based on resistance to chemicals to be encountered in the workplace.

In use, the coils of elongated members 16 can be cut with a sharp object such as scissors or a utility knife to a desired length. Joint members 18 are set against the cut elongated members 16 to allow for a custom fit of a specific containment area. Once the proper configuration of berm 10 is achieved, the silicone sealant 34 is applied to the floor 20 within the width of the elongated members 16 and joint members 18 either in a straight parallel line or in a pattern to ensure proper sealing of elongated members 16 and joint members 18 to the floor. The elongated members 16 and joint members 18 are pressed into place to make proper contact. The strapping material 22 can be cut into desired length to cover any areas that were exposed during cutting of the ends of the elongated members 16. The strapping material 22 is applied to the elongated members 16 and joint members 18 by means of standard strapping glue.

In the foregoing specification certain preferred practices and embodiments of this invention have been set out, however, it will be understood that the invention may be otherwise embodied within the scope of the following claims.

I claim:

1. A device for forming a temporary or permanent berm to contain a spill or leak comprising:

a plurality of elongated members having a housing, said housing having a hollow center provided longitudinally therein, said hollow center being filled with a filler material, each of said plurality of elongated members having a pair of ends and an exposed bottom surface;

a plurality of joint members adapted to connect a pair of said elongated members, each of said plurality of joint members having a pair of ends generally conforming to each of said pair of ends of each of said plurality of elongated members and an exposed bottom surface;

wherein at least two of said plurality of elongated members are connected only at said ends by one of said plurality of joint members to form a berm which at least partially surrounds said spill or leak, a bottom exposed surface of each said plurality of elongated members and each said plurality of joint members being non-invasively secured to the floor surrounding said spill or leak by a sealant such that a liquid impermeable barrier is provided between the berm and the floor.

2. The device of claim 1 wherein said filler material is formed from a flexible, pliable material.

3. The device of claim 2 wherein said flexible, pliable material is one of foam, cellulose, a synthetic material and a mineral material.

4. The device of claim 3 wherein said housing is formed from one of polyurethane and vinyl.

5. The device of claim 1 wherein said sealant is selected from the group consisting of silicone and polyurethane.

6. The device of claim 1 wherein said plurality of elongated members are cut to a desired size from a longer elongated member.

7. The device of claim 6 further comprising strapping material, said strapping material being cut into a desired length to seal said berm along the boundary of said plurality of elongated members and said joint members.

8. The device of claim 1 wherein the berm completely surrounds the spill.

9. A device for forming a temporary or permanent berm to contain a spill or leak comprising:

a. a plurality of elongated members having a housing, said housing having a hollow center provided longitudinally therein, each of said plurality of elongated members having a pair of ends and an exposed bottom surface;

b. a resilient filler material disposed within and substantially filling each of said plurality of hollow elongated members such that if any of said plurality of elongated members are compressed said resilient filler material causes such elongated member to return to an uncompressed shape;

c. a plurality of joint members adapted to connect a pair of said elongated members, each of said plurality of joint members having a pair of ends generally conforming to each of said pair of ends of each of said plurality of elongated members and an exposed bottom surface;

d. each of said plurality of hollow elongated members and joint members having exterior surfaces which contact and block liquid from said spill or leak whereby said spill or leak is contained by said berm;

e. each of said plurality of joint members having a defined angle such that berms of different geometry can be formed to at least partially surround said spill or leak; and f. a sealant disposed between said bottom exposed surface of each said plurality of elongated members and each said plurality of joint members, said sealant non-invasively securing said bottom exposed surfaces to the floor surrounding said spill or leak such that a liquid impermeable barrier is provided between the berm and the floor.

* * * * *